US005429163A

United States Patent [19]

Frenkel et al.

[11] Patent Number: 5,429,163

[45] Date of Patent: Jul. 4, 1995

[54] WOOD-CUTTING METHOD AND TOOL FOR IMPLEMENTATION THEREOF

[76] Inventors: Isaak M. Frenkel, Apt. 422, 34/12 Chudojnikal Avenue, Saint Petersburg 194352; Valery V. Pulit, Apt. 79, 26 Bryantseva Street, Saint Petersburg 195297, both of Russian Federation

[21] Appl. No.: 76,183

[22] Filed: Jun. 14, 1993

[30] Foreign Application Priority Data

Nov. 12, 1992 [RU] Russian Federation ..... 92007670

[51] Int. Cl.[6] ..... B27M 1/06; B26D 1/44

[52] U.S. Cl. ..... 144/364; 83/16; 83/171; 83/651.1; 144/2 R; 144/380

[58] Field of Search ..... 219/221, 229; 83/15, 83/16, 170, 171, 651.1; 144/2 R, 218, 329, 364, 380

[56] References Cited

U.S. PATENT DOCUMENTS

| | | | |
|---|---|---|---|
| 3,756,111 | 9/1973 | Weidenmiller | 83/651.1 |
| 4,258,763 | 3/1981 | Figueredo et al. | 83/651.1 |
| 4,436,010 | 3/1984 | Valentine | 83/171 |
| 4,453,437 | 6/1984 | Ask | 144/364 |
| 4,608,893 | 9/1986 | Huhne | 83/651.1 |
| 4,610,653 | 9/1986 | Savich | 83/651.1 |
| 4,702,138 | 10/1987 | Hattori et al. | 83/651.1 |

FOREIGN PATENT DOCUMENTS

| | | |
|---|---|---|
| 1314 | 5/1926 | U.S.S.R. . |
| 54632 | 3/1939 | U.S.S.R. . |
| 142013 | 11/1961 | U.S.S.R. . |
| 142408 | 11/1961 | U.S.S.R. . |
| 747720 | 7/1980 | U.S.S.R. . |
| 827293 | 5/1981 | U.S.S.R. . |
| 880731 | 11/1981 | U.S.S.R. . |
| 885010 | 11/1981 | U.S.S.R. . |

*Primary Examiner*—W. Donald Bray
*Attorney, Agent, or Firm*—Stanley E. Johnson

[57] ABSTRACT

A wood-cutting method is disclosed using a tool having a cutting part heated by electric current wherein the temperature of the cutting part of the tool, in proximity of the wood, is maintained at a predetermined level. Also disclosed is a wood-cutting tool that has a carrying part and a cutting part in which the cutting part is heated by electric current. The cutting part is blunt and projects beyond the side surfaces of the carrying part. In order that the temperature of the cutting part be maintained at a predetermined level, the tool is provided with a temperature regulator with at least one temperature-sensitive element arranged in thermal communication with the cutting part. The blunt cutting part is formed as a bulbous rigid member selectively coated with an electrically insulative coating that supports a film electric resistance heating element which in turn is covered by an outer protective covering. A heat responsive sensing element, temperature reference and comparator and adjustable electric power control maintain the temperature of the cutting element at a selected level during cutting.

4 Claims, 2 Drawing Sheets

WOOD-CUTTING METHOD AND TOOL FOR IMPLEMENTATION THEREOF

FIELD OF INVENTION

The present invention relates generally to cutting wood using tools heated by electric current, and to a tool for cutting wood in which heat emanating from the tool cuts the wood. Tools of the present invention can be used for sawing, drilling and otherwise cutting wood.

BACKGROUND OF INVENTION

Methods of wood cutting, using tools heated by electric current have been long known in the art. Among the known methods are methods of cutting the wood by a hot wire or band reciprocating between the wood-cutting line (for this reference may be made to SU, A, 1314, 142013, 142408, 827293, 885010), by a knife with an electrically heated cutting edge (reference may be made to SU, A, 747720), or by chain and circular saws with electrically heated teeth (see SU, A, 54352, 880731).

The wood heated to 240° . . . 270° C. is known to be destroyed, i.e. it is subjected to a thermal destruction process. This circumstance is used in the known methods to increase the efficiency of wood cutting and to make it completely sawdustfree.

It is apparent to those skilled in the art that such methods are most effective, when the heated cutting part of the tool only produces a thermal destruction of the wood in the tool-feeding direction, avoiding any mechanical contact between the tool and the unheated wood, that is, with an active and steady process of thermal breakdown of the wood as the tool moves forward.

Should there be contact of the tool with the wood mechanical friction of the tool against the wood layers causes the power consumption of the cutting process to be increased and contributes to a substantially earlier wear of the tool, apart from charring the wood layers along the surface of the cut.

The instability of the process of thermal breakdown of the wood and the consequent mechanical contact between the tool and the wood is a major disadvantage of the methods corresponding to the present state of the art. In particular, it has been found by the inventors that the stability of the thermal breakdown process is distributed by the rapidly changing power consumption of the cutting process, which is by no means compensated in the above known methods.

Wood is known to have a nonuniform structure, i.e. a varying density of annular rings, the presence of knots, rots etc. The areas of increased density exhibit a greater heat absorption, and more energy is released, in these areas, by the heated cutting part of the tool, leading to a more intense cooling of the cutting part. In this case, the wood of the increased-density areas is heated to a smaller extent than it would be required for a stable and active process of thermal breakdown of the wood; in other words, in these areas, there is no thermal breakdown of the wood in the tool-feeding direction. As a result, the tool mechanically contacts the wood layers, thus slowing down the cutting process. Due to a mechanical contact and the consequent friction between the cutting part of the tool and the wood, the wear of the cutting part is enhanced, resulting in an early failure of the tool, as well as an increased power consumed for cutting wood.

In the smaller-density areas, heat absorption is low, and less energy is released by the heated cutting part of the tool in these areas, leading to an overheated tool, which also may cause its premature failure.

In addition, the slowing-down of the cutting process in the higher-density areas results in a longer heating of the more porous areas of the wood adjoining thereto along the cutting line, which will cause it to be charred. Carbon, which is an extremely refractory material exhibiting good heat-insulating properties, prevents the heating and thermal breakdown of the wood layers lying beyond the charred layer. Moreover, carbon is strong enough and exhibits abrasive properties. Efforts to overcome the charred layer causes increased wear of the tool and thus, further reduces its service life. Additional power is required to get through the charred layer, thus impairing the effectiveness of the cutting process. The charred surface of the cut results in degraded consumer quality of the wood, and therefore, an additional treatment of the surface proves to be necessary in a number of cases.

The above will be illustrated by a more detailed discussion of known methods of wood cutting and tools for implementing the same.

According to a method disclosed in SU, A, 827293, wood is cut by a wire heated by electric current and reciprocating between two current-supplying roller contacts adjoining the wood on the opposite sides thereof. The device is provided with spring-loaded templates rigidly attached to the current-supplying roller contacts, with an electric current passed through the wire. As the wood is cut, the templates closely contact the wood. Depending on the length of the wire section buried into the wood, the voltage applied to the current-supplying contacts is varied, thereby providing an average heating of the cutting part of the wire introduced into the wood up to a temperature level specified by the cutting conditions (above 400° C.). The maximum value of said temperature of the wire is limited by its strength characteristics.

In this method, as well as in the other known methods, however, the rapidly changing power consumption of the cutting process is in no way compensated. As a result, in more porous areas of the wood, the wire is overheated leading to its more rapid wear. In the denser areas of the wood, the wire is overcooled, with the consequent mechanical friction thereof against the wood and a more rapid mechanical wear. In this case, the looser, more porous, areas of the wood, adjacent the denser areas along the cutting line, get charred. The mechanical penetration of the wire through the denser areas of the wood and the charred layers, is made difficult because of the low specific strength of the wire.

Known in the art are tools having a high specific strength and comprising a carrying part and a cutting part heated by electric current. Such tools include, for example, chain and circular saws disclosed in SU, A, 54632 and SU, A, 880731, and a knife as disclosed in SU, A, 747720, wherein, in order to minimize the power consumption, the cutting part is divided into sections along its length, each section being separately heated. In this case, during the cutting process, the electric power is only consumed at those sections which directly participate in the wood cutting process.

The above tools do not provide stability of thermal breakdown of the wood because of the heat release failing to follow the rapidly changing power consumption of the cutting process. Another factor disturbing the thermal breakdown process stability and producing a mechanical contact of the tool with the unheated layers of the wood is the shape of the cutting part of the tool. In all the known tools (with the exception of the wire), the cutting part is formed by a sharpened edge. Because of a low surface area of the thermal contact between the edge and the wood, and due to a high unit pressure at the edge, the underlying layers of the wood do not have enough time, as the wood is cut, to be heated to a temperature level sufficient for the wood to be thermally destroyed. The tool is thus introduced into the wood largely as a result of mechanical destruction of the wood by the cutting part of the tool, thus substantially increasing the wear of the tool.

Also, because of the varying cross-section of the pointed cutting edge, it is rather difficult to maintain a uniform temperature in the process of cutting, which again disturbs the stability of thermal breakdown of the wood.

In addition, if the cutting part of the tool is formed by a narrow pointed edge heated by electric current, as in SU, A, 747720, and the surfaces of the carrying part project beyond the heated surfaces of the cutting part, the cold side surfaces of the carrying part slow down the penetration of the tool, thus increasing the power consumption needed for wood cutting.

If, on the other hand, the cutting part heated by electric current is made more elongated, in the tool-feeding direction, forming, say, a band (SU, A, 142013) or a tooth (SU, A, 54632), the thermal action on the wood layers adjoining the heated side surfaces of the cutting part is extended, and these layers are charred thus impairing the consumer quality of the cut.

SUMMARY OF INVENTION

It is an object of the present invention to provide a wood-cutting method and a tool that would allow an improved stability of the process of thermal destruction of the wood in the tool-feeding direction, thereby avoiding a mechanical friction of the tool against the wood and its consequent overheating, and also minimizing the tendency of the wood to be charred, thus extending the life of the tool, improving the quality of the cut and increasing the cutting efficiency.

With this object in view, there is provided a wood-cutting method realized by introducing a tool having a cutting part heated by electric current, wherein, according to the invention, the temperature of the cutting part of the tool in the cut area during cutting is maintained at a predetermined level.

As found out by the inventors, the temperature of the cutting part of the tool in contact or in close proximity with the wood, which is maintained at a predetermined temperature level, provides compensation of a rapidly changing power consumption for the cutting process, thus increasing stability of thermal destruction of the wood, in the tool-feeding direction, avoiding a mechanical friction of the tool against the wood and its overheating, and minimizing the degree of charring the wood, thus extending the service life of the tool and improving the quality of the wood surface processed, apart from reducing power consumption necessary for cutting.

Specifically, as the tool passes the areas of denser wood with increased heat absorption, prevention of over-cooling the cutting part of the tool in this region results in a thermal destruction of the wood in the tool-feeding direction, thus eliminating a mechanical friction of the cutting part of the tool against the wood. In this case, the cutting process will be but slightly slowed down, as the release of heat by the thermostabilized cutting part will be increased, with the consequently lesser degree of charring the looser layers of the wood adjacent the cutting line. The temperature of the cutting part of the tool maintained at a predetermined level further minimizes its overheating in the looser areas.

The temperature of the cutting part of the tool that is maintained, as the wood is cut, is dependent on a plurality of factors such as: the species of the wood processed, its humidity, the material the cutting part of the tool is made of, the tool-feeding force, etc. It is known that the cutting part temperature must be sufficient for the layers of the wood in contact therewith to be locally heated to 240° . . . 270° C., i.e. the temperature at which the wood is thermally destroyed.

Various methods of maintaining the temperature are available, depending on the specific kind of the tool employed.

In case a wire reciprocating between the current-supplying roller contacts adjoining the wood on the opposite sides thereof is used as the cutting part of the tool, the temperature of the cutting part of the wire is maintained in the following way. The wire temperature in proximity to one of the current-supplying contacts is measured and compared to a predetermined value, and then, according to the signals resulting from comparison of said two temperatures, the power of the electric current supplied to the wire for its heating through the current-supplying contacts, is controlled so that the temperature is maintained equal to a predetermined value.

Now the reciprocating wire in proximity to the current-supplying contact is at a temperature which is close proximity to that it has to be within the wood, and therefore, the rapidly changing power consumption of the cutting process as the wire temperature is changed after passing the wood, is compensated by controlling the electric current power supplied to the wire.

In some cases, it may be preferable that a wire making translational movements between two current-supplying roller contacts adjoining the wood on the opposite sides thereof be used for cutting the wood. In this case, according to the invention, a wire preheated to a specified temperature sufficient to provide thermal destruction of the wood is fed to the current-supplying contact laying forward of the wood, as the wire moves. In order to maintain the temperature of the cutting part of the wire in contact with the wood at a predetermined level, the temperature of the wire, as it leaves the wood, is measured, and the signal resulting from comparison between the predetermined and measured temperature is then used to control the power of the electric current supplied to the wire through the current-supplying contacts adjacent the wood.

The use of a wire making a translational movement along the cutting line, for cutting the wood, enables kinematics of the devices to be simplified under stationary conditions, compared to devices involving a reciprocating motion of the wire.

The problem is also solved by providing a wood-cutting tool comprising a carrying part and a cutting part heated by electric current, wherein, according to the invention, the cutting part is made blunt and projecting beyond the side surfaces of the carrying part.

It has been discovered by the inventors that, as the wood is cut, a uniform temperature is provided at the blunt cutting part throughout its working surface, which improves the stability of the thermal destruction process and makes it easier to maintain the temperature of the cutting part of the proposed tool at a predetermined level, in contrast to the pointed edge which, as it was mentioned above, fails to provide the uniformity of temperatures.

As the cutting part is made blunt and has a lower unit pressure and a larger area of thermal contact than is the case with the pointed edge, the layers of the wood in contact with the cutting part of the tool, as it penetrates the wood, are heated uniformly and sufficiently to reach a temperature necessary for thermal breakdown of the wood, thus increasing the stability of thermal destruction of the wood in the direction of feeding the tool, and avoiding mechanical friction of the cutting part against the wood.

Furthermore, as the cutting part projects beyond the cold side surfaces of the carrying part, said cold surfaces will not prevent penetration of the tool, thereby increasing the cutting efficiency.

In order to maintain the temperature of the cutting part at a predetermined level, the tool is provided with a temperature regulator with at least one temperature-sensing element in thermal contact with the cutting part.

The number of temperature sensors and their arrangement is determined by the design of the tool and in particular, its cutting part.

In case the cutting part of the tool is divided, along its length, into a number of separately heated sections (as in SU, A, 747720), it is preferred that each of the sections be provided with a temperature sensor.

With such embodiment of the cutting part of the tool and the temperature regulator, the rapidly changing power consumption required for the cutting process is more finely adjusted, which is especially the case for the tools with an elongated cutting part.

LIST OF DRAWINGS

The invention is further illustrated by a detailed description of its embodiments with reference to the accompanying drawings in which.

DESCRIPTION OF PREFERRED EMBODIMENTS

As the claimed method is realized through operating the tools, its description will be given hereinbelow, as their operation is described.

FIGS. 1 to 7 represent embodiments of wood-cutting tools, according to the invention. The component parts performing identical functions are designated by the same reference numbers in FIGS. 1 to 7.

Figure 1:
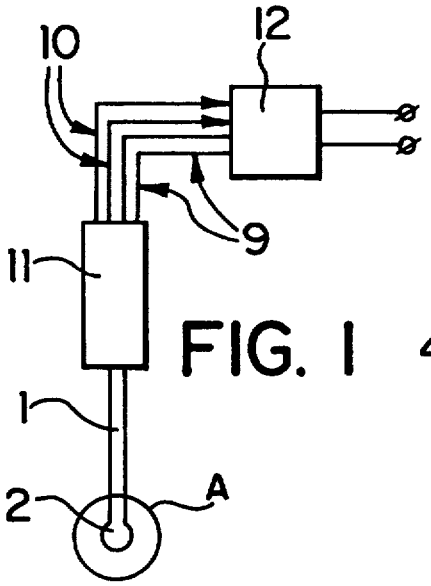
FIG. 1 represents an awl, according to the invention.

The awl shown in FIG. 1 comprises a carrying part 1 formed by a tube with a cutting part 2 attached to its end. The cutting part 2 is formed by a hollow metal ball 3 (FIG. 2) coated on the inside and on the outside with an electro-insulating film designated respectively 4A and 4B. A current conducting layer (resistance heating element) of an electric heater 5 is evaporated over the outside coating layer 4B, while on the inside coating layer 4A there is deposited the heat-sensitive layer of a temperature sensor 6, which is in thermal communication with the electric heater 5. The electric heater 5 is coated, on the outside, with an electro-insulating layer 7 which in turn is covered by a protective sheath 8 having a good thermal conductivity and in thermal communication with the electric heater 5. The outside diameter of the protective sheath 8 of the cutting part 2 exceeds the outside diameter or dimension of the carrying part 1. Current leads 9 of the electric heater 5 and signal leads 10 of the temperature sensor 6 are built into the carrying part 1 of the awl and brought out, through a holder 11, to a temperature regulator 12 of a known design.

The proposed awl is most preferably used in profile cutting for punching holes and subsequent cutting by means of a wire.

Figure 3:
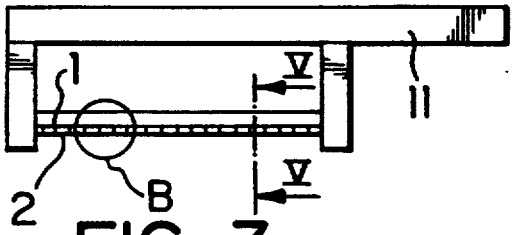
FIG. 3 is a side view, of a knife type cutting element according to the present invention.
Figure 4:
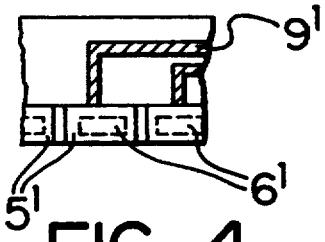
FIG. 4 is the encircled portion B of FIG. 3 on a larger scale.
Figure 5:
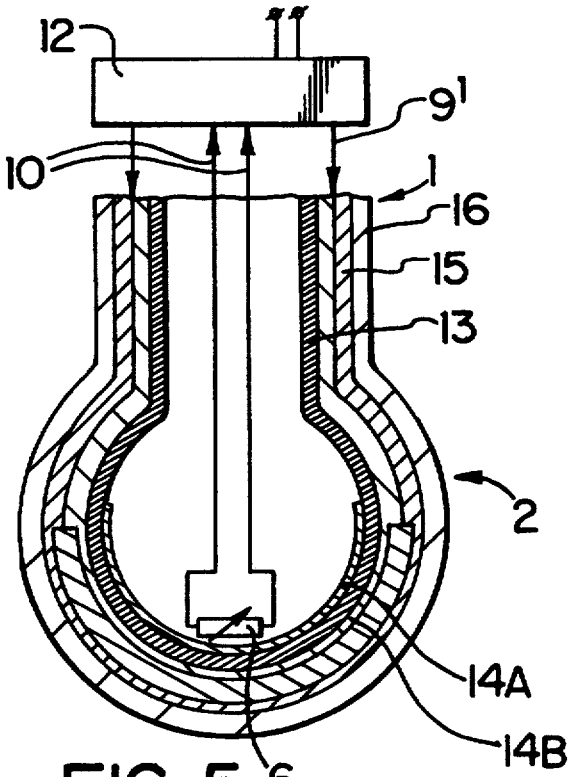
FIG. 5 is a cross-sectional view along line V—V of FIG. 3 on a larger scale.

Deeper profile cuts are best made and end faces formed using a tool of the knife type as shown in FIGS. 3 to 5.

Referring to these Figures the knife comprises a carrying part 1 formed by a pair of blades with a cavity therebetween, and a blunt cutting part 2. The cutting part 2 is formed by a hollow metal shell 13 (FIG. 5) coated, on the inside and outside, with respective electro-insulating films 14A and 14B. A current-conducting layer of an electric heater 5 is evaporated on the outside film 14B and the heat-sensitive layer of the temperature sensor 6, being in thermal communication with the electric heater 5, is on the inside of film 14A. The current-conducting layer of the electric heater 5 and the heat-sensitive layer of the temperature sensor 6 are deposited on the metal shell 13 as two isolated sections $5^1$ and $6^1$ (FIG. 4), respectively, either of the sections $5^1$ and $6^1$ being provided with their individual current leads $9^1$ and signal leads 10 (FIG. 5) mounted within the cavity of the carrying part 1 and terminated, through a holder 11, by a multiple-way temperature regulator 12 of any known design.

Such embodiment of the cutting part 2 allows a separate, along the cutting line, compensation of the rapidly changing power consumption of the process, resulting in a more stable thermal destruction of the wood under the cutting part 2.

The electric heater 5 is coated, on the outside, with an electro-insulating layer 15 and a protective sheath 16 featuring good thermal conductivity and being in thermal contact with the electric heater 5. The outer surfaces of the protective sheath 16 of the cutting part 2 project beyond the side surfaces of the blades of the carrying part 1.

Other embodiments of the wood-cutting tool are also possible, and therefore, the invention is in no way restricted to the aforementioned examples or individual elements, and is subject to modifications and additions, within the scope of the present invention, as defined by the appended claims.

Specifically, a wire heated by electric current may be used as the tool for cutting wood. The devices in which the wire is employed are of a rather simple design.

Figure 6:
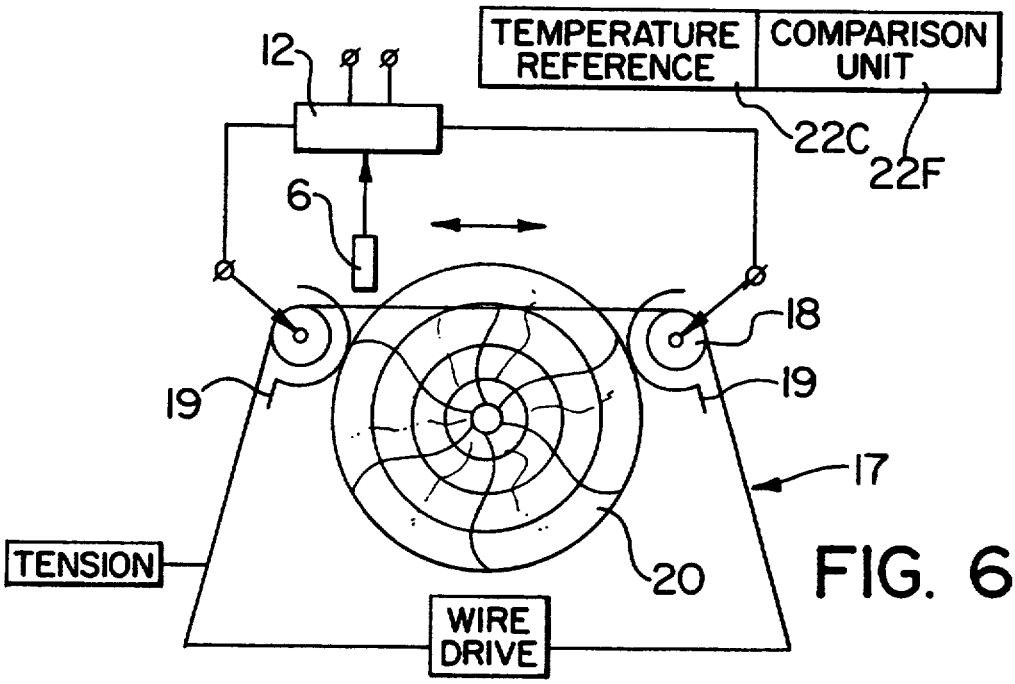
FIG. 6 is a diagrammatic view of a part of a device of the present invention for cutting wood by a heated wire that is reciprocated along the wood-cutting line.

In order that the wire be introduced into the wood, it is made to move either in a reciprocating or in a translational way long the cutting line. FIG. 6 shows part of a device for cutting the wood by a wire electrically heated and reciprocating along the wood-cutting line. The device comprises a wire tool 17, two current-supplying roller contacts 18 mounted on spring-loaded templates 19 which are similar to those described in SU, A, 827293, so that the current-supplying roller contacts 18, when in their operating positions, are held tightly against the wood on the opposite sides thereof. The section of the wire lying between the current-supplying contacts 18 is the cutting part 2 of the tool 17. According to the invention, the device also includes a temperature regulator 12 with its temperature-sensing element 6 disposed in proximity to one of the current-supplying contacts 18. In addition, the device includes a wire-tensioning means 30 and a wire reciprocating drive 31. The above means and drive may be of any known design.

Figure 7:
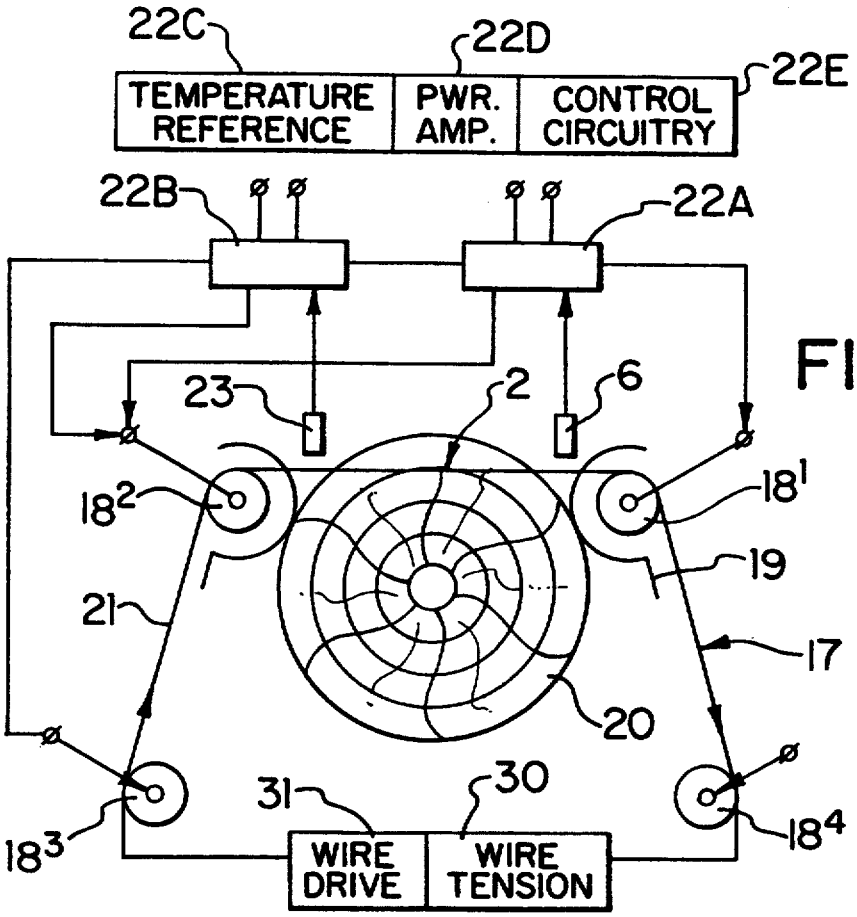
FIG. 7 is a diagrammatic view of a device of the present invention for cutting wood by a wire making a translational movement along the wood-cutting line.

In another embodiment of the wood-cutting device using a heated wire, shown in FIG. 7, a translational movement of the wire along the cutting line of wood 20 is generated. The device comprises a tool 17 of the wire type, three current-supplying roller contacts $18^1$, $18^2$, $18^3$, two of which, $18^1$ and $18^2$, are mounted on spring-loaded templates 19, so that in the operating position, the current-supplying contacts $18^1$ and $18^2$ are pressed to the wood 20, on the opposite sides thereof.

A section 21 is formed between the current-supplying contacts $18^3$ and $18^2$ for preheating the wire prior to its introduction into the wood 20. The wire section between the current-supplying contacts $18^1$ and $18^2$ is the cutting part 2 of the tool 17. The device includes a temperature regulator 22A with its temperature sensor 6 disposed in proximity to the current-supplying contact $18^1$ lying at the point where the wire leaves the wood 20. In addition, the device includes a temperature regulator 22B with a temperature sensor 23 disposed in proximity to the current-supplying contact $18^2$, upstream of the wood 20, with reference to the direction of travel of the wire. The temperature regulators 22A and 22B are designed in a known manner. The temperature regulator 22A serves to control the temperature of the cutting part 2 of the wire 17 between the current-supplying contacts $18^1$ and $18^2$, while the temperature regulator 22B controls the temperature of the wire 17 at section 21, before it penetrates the wood 20.

In all of the above embodiments of the wood-cutting tool shown in FIGS. 1–7, the temperature regulators are of any known design and include the temperature sensor 6, a temperature reference element (22C—FIG. 7), a power amplifier (22D—FIG. 7), and a controlling-law generation circuit (22E—FIG. 7). The settings of the regulations are chosen using known methods, according to the required quality of controlling the temperatures and depending on the stability of the circuit selected.

Besides, the device of FIG. 7 includes a wire-tensioning system 30 and a wire-translation drive 31. For reversal of the translational movement of the wire, an additional roller contact $18^4$ is provided in the device, which is arranged in symmetry to the current-supplying roller contact 183 and a switching system (not shown) for switching the temperature sensors 6 and 23 and the temperature regulators 22A and 22B.

According to the invention, the proposed wood-cutting method operates as follows.

Experimentally, by means of trial cuts, optimum cutting regimes are defined, namely: temperature of the cutting part of the tool and its feeding force. Different criteria of the optimum regimes are possible, such as minimization of the specific power consumption per unit cut area, or else, achievement of the desired quality of cut. Section of the tool-feeding force is made, in a known manner, based on the necessity to provide a maximum possible cutting speed (compatible with this particular tool and the optimum cutting criteria specified). It has been experimentally shown by the inventors that, for the most common species of wood encountered in medium latitudes (birch, lime, oak, etc.) in order to achieve said optimization criteria, the temperature of the cutting part of the tool must be within a range from 600° C. to 800° C., with feeding forces enabling the wood to be cut at the rate of 10 to 12 mm/sec. The temperature regulator settings are selected in a known way, according to the allowable deviations of temperatures at the temperature sensor. It was experimentally shown by the inventors that deviation of temperatures at the sensor, ranging from 5° C. to 10° C., is quite tolerable to permit a sufficiently low specific power consumption per unit cutting area and to obtain a satisfactory quality of the cut surface.

As mentioned above, the specified temperatures of the cutting part of the tool may be defined more exactly by experiment.

The cutting process using, say a knife shown in FIGS. 3 to 5 is realized as follows. A predetermined temperature is first set at the temperature reference (not shown) of the temperature regulator 12 (FIG. 3). As the tool penetrates the wood, the temperature of individual sections $5^1$ of the electric heater 5 is measured by the respective temperature sensors $6^1$ (FIG. 4). The outputs from the sensors $6^1$ are applied, along with the reference signal, to a comparison circuit (not shown), a power amplifier (not shown) controlling, based on the comparison result, the electric current power applied to each section $5^1$ of the electric heater for heating the cutting part 2 of the knife, compensating the rapidly changing power consumption of the cutting process, so that the temperature of each section $5^1$ in contact with the wood is maintained at a predetermined level. For example, if a denser area (such as a knot) happens to be in the way of the cutting part 2 of the tool, an increased heat absorption of such area results in a lower temperature of the cutting part 2 within that electric heater section $5^1$ which contacts said area, and this is sensed by the temperature sensor $6^1$ being in thermal contact within said section $5^1$ of the electric heater 5. If the temperature of the cutting part 2 sensed by the temperature sensors $6^1$ proves to be below that set by the reference element, the power amplifier raises the power of the electric current supplied to the sections $5^1$, being at a reduced temperature, to have them increased in temperature to a predetermined level. Because of the higher power, the tool will pass, at a but slightly slower rate, the area of increased density without mechanically contacting the wood. In this case, there is essentially no charring of adjacent (along the cutting line) looser areas of the wood.

If a loose area of the wood or an air cavity is encountered in the way of the cutting part 2 of the knife, which exhibits a low heat absorption, no overheating of the tool will occur, since the temperature regulator 12 will reduce the power of the electric current supplied to that section $5^1$ in contact with the wood area of a lower heat absorption, thus reducing the temperature of said section $5^1$ down to a predetermined value.

Since the cutting part 2 of the knife is made blunt a uniform temperature is provided on its working surface and this temperature is controlled providing a predetermined temperature. As the tool penetrates the wood, its layers adjacent the hot working surface of the cutting part 2 are also heated uniformly enough to a temperature level necessary for thermal breakdown of the wood, thereby increasing the stability of thermal destruction and preventing the mechanical friction of the cutting part 2 of the tool against the wood.

Further, as the cutting part 2 extends beyond the cold side surfaces of the blades of the carrying part 1, these do not prevent the tool from penetrating the wood, thus minimizing power consumed for cutting and charring the surfaces of the cut, as compared with those tools whose side surfaces either project beyond the working surfaces (as in SU, A, 747720) or are flush with them (SU, A, 142013, 54632), respectively.

Figure 2:
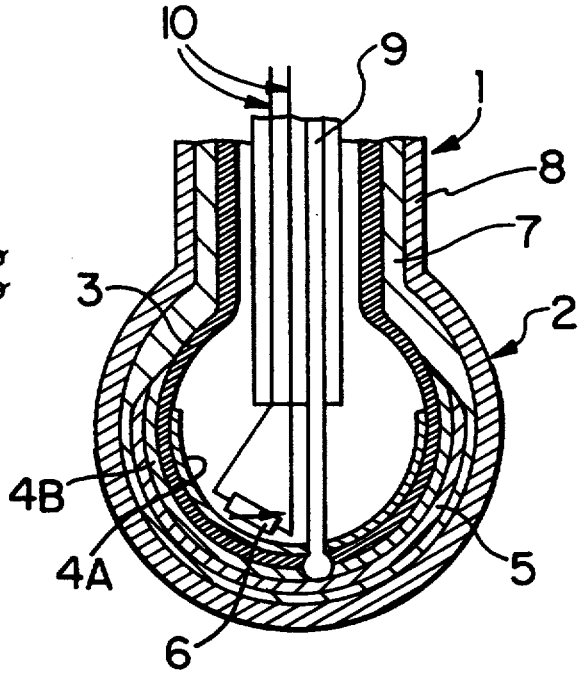
FIG. 2 is a longitudinal section, on a larger scale, of a lower end unit of FIG. 1.

The use of an awl-like tool of the type shown in FIGS. 1 to 2 for cutting, is essentially similar to the use of the knife, with the only exception that the temperature regulator 12 in the awl comprises a single temperature sensor 6.

The method of cutting the wood by a heated wire has some specific features. Introduction of the wire into the wood is assisted by a pressure provided at its ends, in the forward direction of the wire, and by having the wire make either a reciprocating (FIG. 6) or a translational (FIG. 7) movement along the wood-cutting line.

Referring to the device represented in FIG. 6, the process of cutting the wood 20 is as described hereinbelow. A predetermined temperature is set at a reference element 22C. The wire temperature is measured by the temperature sensor 6, after the wire has passed the wood 20. In this case, since the wire reciprocates inside the wood, its temperature in proximity to the current-supplying contact 18 adjacent the wood 20 is close to its temperature inside the wood 20. The outputs of the temperature sensor 6 and the reference element are both applied to the comparison circuit 22F. Depending on the comparison signal, the power amplifier controls the power of the electric current passed through the cutting part 2 of the wire between the current-supplying contacts 18, to heat it up so that its temperature is maintained at a predetermined level.

For example, if a knot or another area of increased density occurs in the way of the wire 17, the wire is bent here and, as it enters the areas, it is cooled and slowed down to a greater extent. The temperature sensor 6 senses said temperature of the wire 17, and after it has been compared with the predetermined value (which is accordingly higher), the power amplifier raises the power of the electric current supplied to the cutting part 2 of the wire 17, to heat it up. As the wire 17 is bent at the knot, its unit pressure at the point exceeds that existing in adjacent sections, and the additional power is consumed largely by the knot. This results in a thermal breakdown of the wood 20 at the knot, and the wire gets through the knot without any mechanical friction against the wood. The wire 17 will be but slightly slowed at the knot, with the consequently smaller probability of the wire breaking. In this case, the layers of the wood at the section adjacent the knot, along the cutting line, will not be subjected to an excessively long thermal action, and so will not be charred so much.

The wood cutting by a wire making a translational movement along the cutting line is accomplished in an essentially similar way. The difference resides in preheating the wire 17 prior to its feeding to the wood 20 (FIG. 7), using an electric current passed through the current-supplying contacts $18^2$ and $18^3$ disposed before the wood 20 as the wire moves. The temperature of the wire 17, at sections 2 and 21, is maintained within the specified limits by known methods, i.e. using the temperature regulators 22A and 22B, respectively.

After the wire 17 has been completely wound, an additional, fourth, current-supplying contact $18^4$ is connected to the regulator 22, with the current-supplying contact $18^1$ also connected thereto, so that the wood 20 can also be cut as the wire is reversed, thus avoiding an idle rewinding.

The cutting process involves thermal destruction of the wood by the melting of the cellulose and lignin from the application of intensive energy in a concentrated area. Produced during cutting is a vapour of dissolved cellulose and water and a polymer film of about 0.02 mm thickness or less.

We claim:

1. A method of making a cut in wood by thermal breakdown of the wood comprising providing a tool that has an element controllably heated by electric current, placing said element at a location on said wood where the cut is to commence, applying electric current to said element to heat the same to a temperature sufficient to cause a thermal breakdown of the wood and thereby commencing the cut, moving the element into the cut as the cutting progresses through the wood as a result of thermal breakdown of the wood, sensing the temperature of the element during formation of the cut, adjusting the temperature of the element in the wood in response to the sensed temperature to maintain a temperature level sufficient for cutting the wood by said thermal breakdown and controllably maintaining said temperature level within a selected range of deviation therefrom during cutting.

2. A method as defined in claim 1, wherein the operating temperature is within the range of 600° C. to 800° C. and wherein said temperature level is maintained within a deviation in the range of 5° C. to 10° C.

3. A method as defined in claim 1, wherein the tool element is a wire mounted for reciprocating movement between two spaced apart current-supplying contacts on opposite sides of the cut in the wood, said method, comprising measuring the temperature of the wire in proximity to one of said current-supplying contacts, comparing said measured temperature with a predetermined temperature, and, depending on the comparison results, adjusting the electric power applied to the wire via said current-supplying contacts so that the wire temperature is maintained at a predetermined level.

4. A method as defined in claim 1, wherein the tool element is a wire mounted to travel between two current-supplying contacts disposed respectively on opposite sides of the wood, said method comprising, during cutting, causing translational movement of the wire, preheating said wire to a predetermined temperature upstream of a first one of said current-supplying contacts and which is disposed upstream of the wood with reference to the direction of travel of the wire as it moves, measuring the temperature of the wire as it leaves the wood, comparing said measured temperature with a predetermined temperature, and adjusting the electric power applied to the wire via said current-supplying contacts so as to maintain the wire temperature at a predetermined level.

* * * * *